United States Patent [19]

Bennett

[11] 4,156,505

[45] May 29, 1979

[54] DEVICE FOR PRODUCING FOAM

[76] Inventor: Robert S. Bennett, 170 Sturbridge Rd., Easton, Conn. 06425

[21] Appl. No.: 837,556

[22] Filed: Sep. 28, 1977

[51] Int. Cl.[2] ..... B65D 5/58

[52] U.S. Cl. ..... 239/327; 239/343; 239/372; 222/212

[58] Field of Search ..... 239/327, 328, 343, 372; 222/189, 190, 211, 212

[56] References Cited

U.S. PATENT DOCUMENTS

| | | | |
|---|---|---|---|
| 3,874,562 | 4/1975 | Hazard | 222/211 X |
| 3,963,150 | 6/1976 | Steiman et al. | 222/211 |
| 3,973,701 | 8/1976 | Gardner | 222/190 |
| 3,985,271 | 10/1976 | Gardner | 239/343 X |

*Primary Examiner*—Robert W. Saifer

[57] ABSTRACT

Foam is produced when a reservoir is deformed by squeezing. When pressure is applied to the reservoir, a vent passage is sealed by a flexible washer, while liquid is forced up a tube and through a passage in a cylindrical member to a region at the top of that member. Air is forced through another passage and swirls into the same region to mix with the liquid. As the pressure of the mixture increases, a ball valve located above the region, is caused to open which allows discharge of the mixture. When the pressure is released, the valve is sealed and suction pulls the washer away from the vent to allow air back into the reservoir.

4 Claims, 5 Drawing Figures

FIG. 1
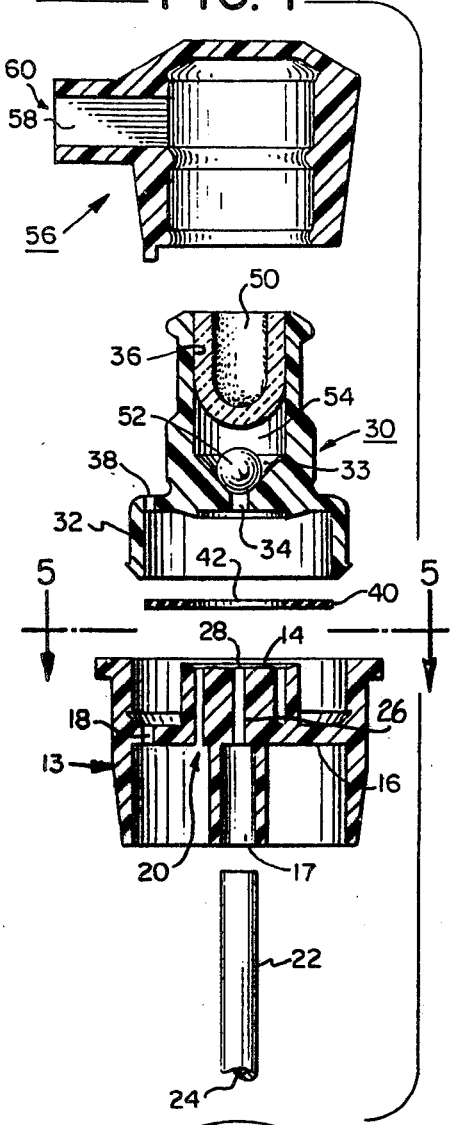
FIG. 2
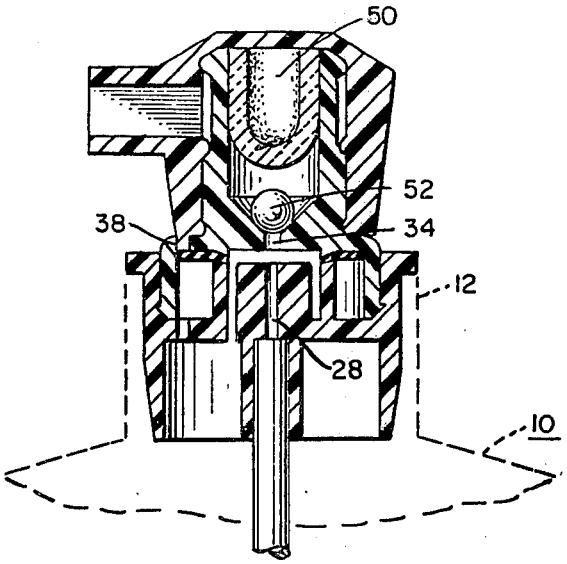
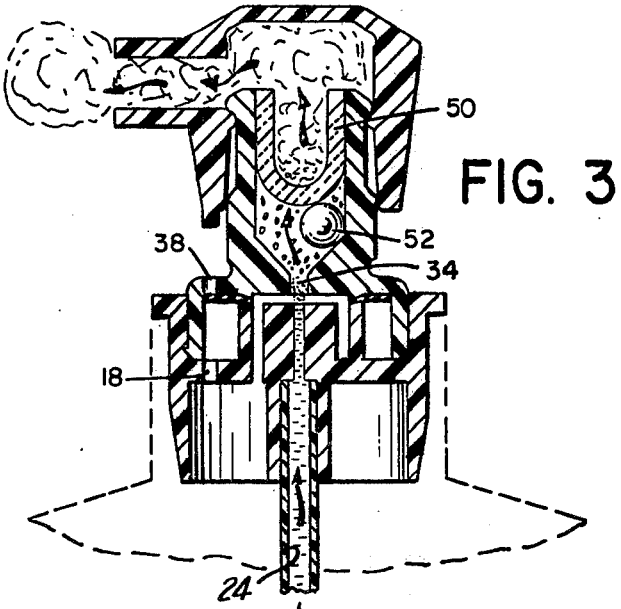
FIG. 3
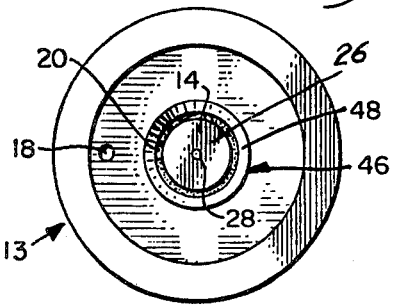
FIG. 5
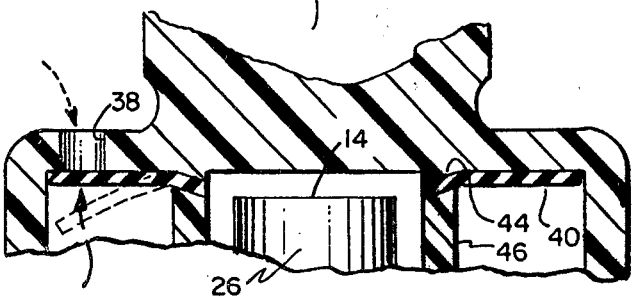
FIG. 4

DEVICE FOR PRODUCING FOAM

PRIOR ART STATEMENT

Known foam producing devices of the same general type as disclosed herein are shown in the following U.. Pat. Nos.

2,223,256
2,281,447
2,715,981
3,176,883
3,422,993
3,709,437
3,874,562
3,937,364
3,973,701
4,022,351

The invention differs both in structure and in function from the devices shown in the above identified patents.

BACKGROUND OF THE INVENTION

Known foam producing devices as shown in U.S. Pat. No. 3,709,437 employ a deformable reservoir containing foamable liquid and air, a discharge orifice, foam producing means including a foam homogenizing overlay or filter, and a ball check valve disposed in the foam producing means. The means also has air passages in a well portion which defines a mixing chamber. When the reservoir is compressed, the liquid and air are mixed in the chamber. The mixture is passed through the overlay to produce foam which is then discharged through the orifice. The check valve prevents downward flow of the liquid after the compression force in the reservoir is released, thus reducing the time to produce foaming upon subsequent compression. While the reservoir is returning to its uncompressed state after the compression force is released, air flows from outside the device in reversed direction through the same air passages into the reservoir for use in subsequent foam producing operations.

However, when these known devices are used for several foam producing cycles in rapid succession, a build up of foam will occur at the orifice, producing clogging. The devices then have to be unclogged before more foam can be produced. Moreover, the quantity of foam produced during each cycle is substantially reduced as compared to the immediately preceding cycle whereby the number of cycles required to produce foam, when these cycles occur in rapid succession, must be substantially increased to produce the same amount of foam.

The present invention overcomes these disadvantages by eliminating clogging and ensuring discharge of the same quantity of foam per cycle regardless of the rapidity of cycle succession.

SUMMARY OF THE INVENTION

In accordance with the principles of this invention, a device for producing foam from a foamable liquid and air comprises a vertical reservoir with an open neck adapted to contain a quantity of foamable liquid and air. The reservoir is deformed when squeezed and automatically returns to undeformed state when squeezing pressure thereon is released.

A first vertical member is disposed within the reservoir. The first member has a top end disposed adjacent the neck, and also has a horizontal portion extending radially outward below the top end to engage the inner surface of the neck. The first member has a vertical bore extending between and communicating with top and bottom ends for passing liquid therethrough. The horizontal portion has first and second holes disposed intermediate the bore and the neck. A vertically elongated dip tube is disposed at its top end within the bottom end of the bore and has its bottom end disposed adjacent the bottom of the reservoir.

A second vertical member is disposed above the first member with a lower end having a flat central portion disposed adjacent but above the top end of the first member. The lower end of the second member having a vertical flange extending downward from the central portion and engaging the top end of the first member. The second member has a first opening in its upper end which extends downwardly toward a second and smaller opening in its lower end, said first opening tapering inwardly in the vicinity of the second opening. The lower end has a third opening spaced from the second opening and communicating with the outer surface of the second member.

A thin flexible horizontal washer has a central opening overlying the top end of the first member and bears against the lower end of the second member. The washer seals said third opening except when the reservoir is returning from the deformed state to the undeformed state.

Vertical washer support means extends upwardly from said horizontal portion of the first member to said washer and is spaced between said first and second holes. A filter is disposed in the upper end in the first opening whereby a chamber is formed in the second member which extends between said filter and the second opening. A ball smaller than the first opening and larger than the second opening is disposed movably in said chamber, said ball normally sealing off the second opening but being moved out of sealing position when the reservoir is deformed.

In use when the reservoir is squeezed, liquid passes vertically upwardly from the reservoir and the bore in the first member into the space between the top end of the first member and the lower end of the second member as confined to the central opening in the washer. At the same time, air passes upwardly from the reservoir through the second hole (first air passage) and upwardly through the washer support means into the same space. The air enters at an acute angle and combines with the liquid in a swirling action. The pressure of the resultant mixture forces the ball out of sealing position and the mixture passes upwardly through the second opening and the chamber through the filter whereby uniform or homogenized foam is produced. This foam is then discharged at a suitable orifice.

When squeezing pressure is released, the ball returns to sealing position. At the same time, the washer momentarily is deformed, opening the third opening whereby outside air can flow into the reservoir via the second hole.

Devices in accordance with this invention will not clog. Moreover, the quantity of foam produced during any cycle is always the same regardless of the rapidity of successive cycles.

BRIEF DESCRIPTION OF THE DRAWINGS

FIG. 1 is a side view of a device in accordance with the invention wherein the parts are shown in exploded relationship.

FIG. 2 is a view similar to FIG. 1 but showing the parts in assembled relationship with the device ready for use.

FIG. 3 is a view similar to FIG. 2 but illustrating the foam producing action during use.

FIG. 4 is detail view illustrating the sealing and opening action of a washer in the device.

FIG. 5 is a view taken along line 5—5 in FIG. 1.

Referring now to FIGS. 1–5, a manually deformable plastic reservoir 10 containing air and a foamable liquid has an open neck 12. A first vertical plastic member 13 has a top end 14 disposed adjacent the neck and a horizontal portion 16 extending radially outward from a position below the top end to engage and be integral with the neck. Portion 16 has two spaced holes 18 and 20 therein. The member extends below the portion 16 with a bore 17 in which is fitted an elongated vertical dip tube 22 with a bottom open end adjacent the bottom of the reservoir. The tube has a bore 24 having a circular diameter of about 0.075 inches. The section 26 of the member between the top end and the bottom of the portion 16 has a bore 28 aligned with bore 24 but having a smaller diameter of about 0.060 inches.

A second vertical member 30 has a lower end having a flat horizontal central portion disposed adjacent but above end 14 and above 16 and having a vertical peripheral flange 32 which extends downwardly and which engages the the top end of member 13. The member 30 has a circular opening 36 about 0.250 inches in diameter in its upper end. This opening extends downwardly with the same diameter until it tapers inwardly at 33 in the vicinity of a smaller opening 34 about 0.060 inches in diameter in the lower end of member 30. The lower end 32 also has a third opening 38 communicating between the outside and the interior of the lower end.

A thin flexible horizontal washer 40 bears against the inside of end 32 and has a central opening 42 of 0.350 inches diameter aligned with and somewhat larger than end 14, opening 42 being spaced above end 14. The inner horizontal surface of end 32 has a downwardly projecting circular lip 44 which tapers inward and downward at an angle of fifteen degrees. This lip engages the inner periphery of the washer and forces the outer edge of the washer into normal sealing engagement with opening 38. A vertical hollow cylinder 46 open at both ends and circumferentially spaced about section 26 extends upward from portion 16 intermediate holes 18 and 20. The top edge 48 of cylinder 46 is horizontal and has a taper conforming to and aligned with lip 44. This edge 48 bears against the bottom of the washer and thus the washer is held between lip 44 and edge 48.

A foam homogenizing overlay or filter 50 is disposed in the opening 36 and extends downwards, this filter in vertical cross section having the shape of a U. A ball 52 having a diameter of 0.150 inches is disposed in the interior chamber 54 defined within member 30 by the filter and second opening. The ball thus has a diameter smaller than that of opening 36 and larger than that of opening 34.

A cap 56 having a discharge conduit 58 and orifice 60 fits slidably over the outside of member 30 with conduit 58 communicating with filter 50.

Initially the device is in the position shown in FIG. 2 with opening 34 sealed by the ball and opening 38 sealed by the washer. The cap 56 must be raised in order for the device to operate. When the reservoir is deformed by squeezing, the formable liquid is forced upward via the dip tube and bore 28 into the region between top end 14 and the washer opening (which is about fifteen thousanths of an inch deep). At the same time air is forced upward within cylinder 46 via hole 20 and swirls into the same region to mix the liquid and air. As the pressure of this mixture increases, ball 52 is forced upward and the mixture passes through opening 34 and expands to pass through filter 50 whereby the homogeneous foam is produced and is discharged.

When the squeezing pressure is released, the ball falls downward and seals opening 34. The release of pressure produced a momentary suction which moves the outer edge of the washer downward and draws air inward through opening 38 and opening 18 into the reservoir. When equilibrium is established, the washer returns to the original position and the cycle can begin again.

This device will not clog and produces the same quantity of foam during successive cycles even though these cycles occur in rapid succession.

These improvements result from three interacting factors: (a) the use of separate air intake and discharge paths as compared to the known reversal of air flow along a common path; (b) the expansion of the mixture of air and liquid after mixing and prior to passage through the filter as compared to the known action wherein no such expansion is permitted; and (c) the substitution of the filter geometry of filter 52 for the known flat disc filter whereby the foam production action is enhanced.

What is claimed is:

1. A device for producing foam from a foamable liquid and air, said device comprising:

a vertical reservoir with an open neck adapted to contain a quantity of foamable liquid and air which is deformed when squeezed and which automatically returns to undeformed state when squeezing pressure thereon is released;

a first vertical member disposed within the reservoir and having a vertical bore passing between top and bottom ends, the top end being disposed adjacent the neck, a horizontal portion of the first member extending radially outward below the top end to engage the inner surface of the neck, said portion having two horizontally spaced holes disposed therein intermediate the bore and the neck;

an elongated vertical dip tube disposed at its top end within the bottom end of the vertical bore and having its bottom end disposed adjacent the bottom of the reservoir;

a second vertical member disposed above the first member, the second member having a lower end with a flat central portion disposed adjacent but above the top end of the first member, the lower end of the second member having a vertical peripheral flange extending downward from the said flat central portion and engaging the top end of the first member, the upper end of the second member having a first opening which extends downwardly toward a second and smaller opening in the lower end, said first opening tapering inwardly in the vicinity of the second opening, said lower end having a third opening spaced from the second opening and communicating with the outer surface of the second member;

a thin flexible horizontal washer having a central opening overlying the top end of the first member, said washer being disposed adjacent and below said lower end of the second member and sealing said third opening except when the reservoir is returning from the deformed state to the undeformed state;

vertical washer support means extending upwardly from said horizontal portion of said first member to said washer and disposed between said holes;

a filter disposed in the upper end in the first opening whereby a chamber is formed in the second member which extends between said filter and the second opening; and a ball smaller than the first opening and larger than the second opening disposed movably in said chamber, said ball normally sealing off the second opening but being moved out of sealing position when the reservoir is deformed.

2. The device of claim 1 wherein said filter extends downwardly in the first opening and in vertical cross section has the shap of a U.

3. The device of claim 2 wherein the bottom surface of the lower end of the second member has a downwardly extending circular lip engaging the inner periphery of the washer.

4. The device of claim 3 wherein said washer support means is a hollow vertical cylinder with a top horizontal edge aligned with said lip, the washer being held between lip and cylinder.

* * * * *